United States Patent [19]

Lipp et al.

[11] Patent Number: 4,904,828

[45] Date of Patent: Feb. 27, 1990

[54] MULTI-CIRCUIT SLIDE SWITCH ASSEMBLY WITH DISTINCT PLUNGER OPERATED SWITCH

[75] Inventors: Ellis P. Lipp, Charlottesville; Donald L. Ray, Oaklandon, both of Ind.

[73] Assignee: Emhart Industries, Inc., Indianapolis, Ind.

[21] Appl. No.: 248,152

[22] Filed: Sep. 23, 1988

[51] Int. Cl.[4] ..... H01H 15/00

[52] U.S. Cl. ..... 200/16 B; 200/160

[58] Field of Search ..... 200/4, 11 G, 11 J, 16 C, 200/16 D, 16 B, 303; 338/172, 198, 200

[56] References Cited

U.S. PATENT DOCUMENTS

| | | | |
|---|---|---|---|
| 2,303,693 | 12/1942 | Hill | 200/16 C X |
| 2,751,468 | 6/1956 | Brown et al. | 200/16 C X |
| 2,853,565 | 9/1958 | Arthur et al. | 200/16 D |
| 4,072,833 | 2/1978 | Carena | 200/16 D X |
| 4,200,773 | 4/1980 | Komatsu et al. | 200/303 X |
| 4,400,685 | 8/1983 | Chestnut | 338/172 |

*Primary Examiner*—J. R. Scott

*Attorney, Agent, or Firm*—Carl A. Forest

[57] ABSTRACT

A housing has a flat side and an open end opposite the flat side, which open end is closed by a circuit board, sandwiching a slidable contact carrier between it and the flat side. Normal power terminals are carried by the flat side and low power traces by the circuit board. Contacts carried on both sides of the carrier open and close circuits on the flat side and the circuit board as the carrier is slid in the housing. The carrier slides on a stabilizing bar with a highly finished surface, thereby smoothing out force irregularities that could be caused by the small size and differing characteristics of the two sides of the switch.

5 Claims, 7 Drawing Sheets

MULTI-CIRCUIT SLIDE SWITCH ASSEMBLY WITH DISTINCT PLUNGER OPERATED SWITCH

BACKGROUND OF THE INVENTION

1. Field of the Invention

The invention relates in general to multi-circuit automotive electrical switches, and more particularly, to such a switch that incorporates both low power solid state circuits and normal power direct-acting circuits in the same switch.

2. Description of the Prior Art

Multi-circuit switches that include spring blades and contacts that move across metal paths on a housing cover or base are well known. See for example U.S. Pat. No. 4,400,685 issued to Benjamin F. Chestnut. It is also known that the metal paths may be traces on circuit boards. Circuit boards of the type used in solid state circuits (referred to herein as "low" power circuits) generally operate at a significantly lower power than that normally used to directly operate electrical lights, motors and other such electrical devices in automobiles, which will be referred to herein as "normal" power circuits. Moreover, the circuits on such circuit boards are generally significantly more fragile than the circuits associated with the normal power switches. Thus, for both electrical and mechanical reasons, multi-circuit switches do not generally include separated low power and normal power circuit mechanisms in the same switch. This is particularly true when the switches are small in size. However, it is becoming increasingly common to use microprocessors and other solid state circuits in automobiles. Further, the increase in the number of instruments in automobiles, and the generally decreasing size of automobiles has led to a need for switches and other electrical circuits to be greatly reduced in size. Thus it would be very useful to have a switch that both combines normal and low power circuits and at the same time is very compact.

SUMMARY OF THE INVENTION

It is an object of the invention to provide an automotive switch that combines normal automotive and low power circuits and is very compact.

Another object of the invention is to provide an automotive switch in which the low power circuit and normal power circuits are located on opposite sides of a housing and the switching is performed by means of a sliding contact carrier located between the two circuits.

It is a further object of the invention to provide one or more of the above objects in an automotive switch in which the contact carrier slides on a stabilizing bar with a highly finished surface.

It is still a further object of the invention to provide one or more of the above objects in a switch which includes a plunger which is movable in a direction perpendicular to the direction of slide of said carrier and activates one of the circuits.

The invention provides an automotive electrical switch comprising: a housing having at least one substantially flat side and an open end opposite the flat side; first terminal means mounted on the inner surface of the flat side; means for closing the open end of the housing having second terminal means thereon; and a contact carrier slidably located between the flat side and means for closing, the contact carrier comprising: first contact means mounted on a first side of the contact carrier for contacting the first terminal means; second contact means mounted on a second side of the contact carrier opposite the first side for contacting the second terminal means; and lever means for manually sliding the carrier to cause the first and second contacts to contact their respective terminal means. Preferably the means for closing the open end of the housing comprises a circuit board, the second terminal means comprises a trace printed on the circuit board, and the first terminal means comprises bus bar means for carrying a significantly higher electrical load than the trace on the circuit board. Preferably, the switch further comprises a stabilizer bar means for stabilizing the contact carrier in the housing and a connecting means for electrically connecting the first terminal means to the second terminal means and for holding the stabilizing bar means in place in the housing. Preferably the stabilizing means passes through an opening in the carrier and has a highly finished surface.

The automotive switch according to the invention not only successfully combines both the low power and normal power automotive circuits in a single switch but also has a small number of parts and uses a minimum of separate fasteners and is therefore relatively easy to manufacture. Numerous other features, objects and advantages of the invention will become apparent from the following detailed description when read in conjunction with the accompanying drawings.

DESCRIPTION OF THE PREFERRED EMBODIMENT

Figure 1:
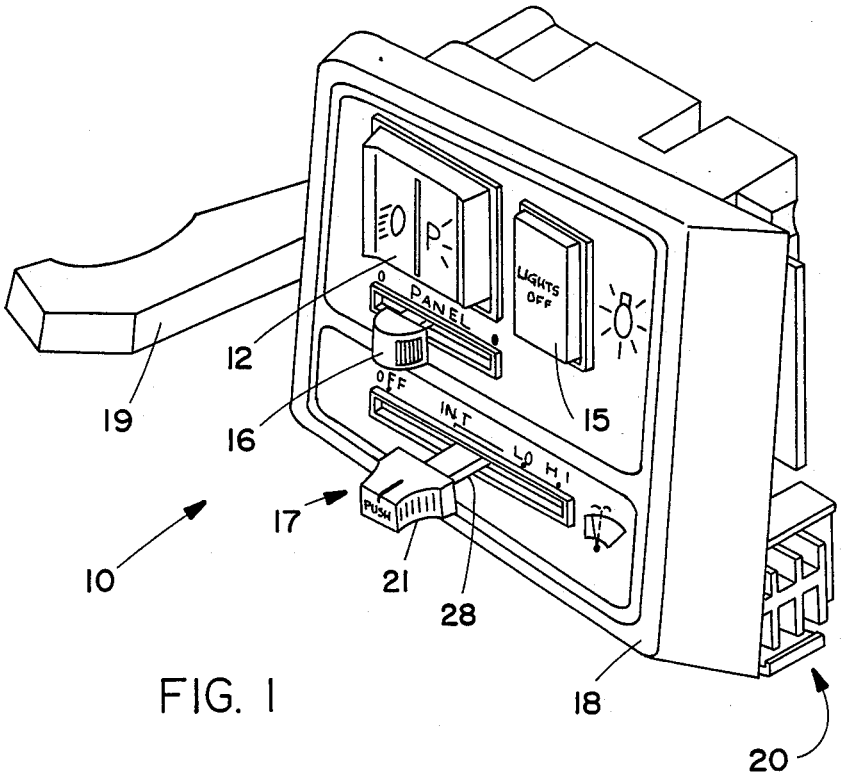
FIG. 1 is a perspective front view of a preferred embodiment of an automotive switch module of which the invention forms a part.

In the preferred embodiment, the switch according to the invention is part of a switch module 10 which controls the turn signal, headlight beam change, panel and interior lights and windshield washer and wiper functions. It is understood that the embodiment shown in only intended to be exemplary and not intended to be limiting of the invention. The assembled module 10 is shown in FIG. 1. The principal functions will be briefly discussed first to orient the reader to the device, and then a detailed description of each part of the invention will be presented. In this description, when the words front, back, up and down are used without specific reference to a figure, then it is in reference to the normal position of the module in use, which is shown in FIG. 1 with the "front" facing to the lower left of the FIG.

Module 10 has two buttons 12 and 15, a lever 16, and a lever means 17 protruding from its front cover 18 and another lever 19 extending from its left side. Button 12 activates a circuit within the module 10 to turn on the parking lights and headlights of the vehicle. Button 15 activates another circuit to turn the lights off. Lever 16 operates the panel and interior lights of the vehicle. Lever 19 operates the turn signal and headlight beam change functions of the vehicle. Lever means 17 is part of a windshield wiper and washer switch subassembly 20 which operates the windshield wipers and washers of the vehicle. The preferred embodiment of the invention is contained within the windshield wiper and wash switch subassembly 20 and therefore this subassembly 20 will be discussed in detail below and the other parts mentioned only as they relate to this subassembly.

Figure 3:
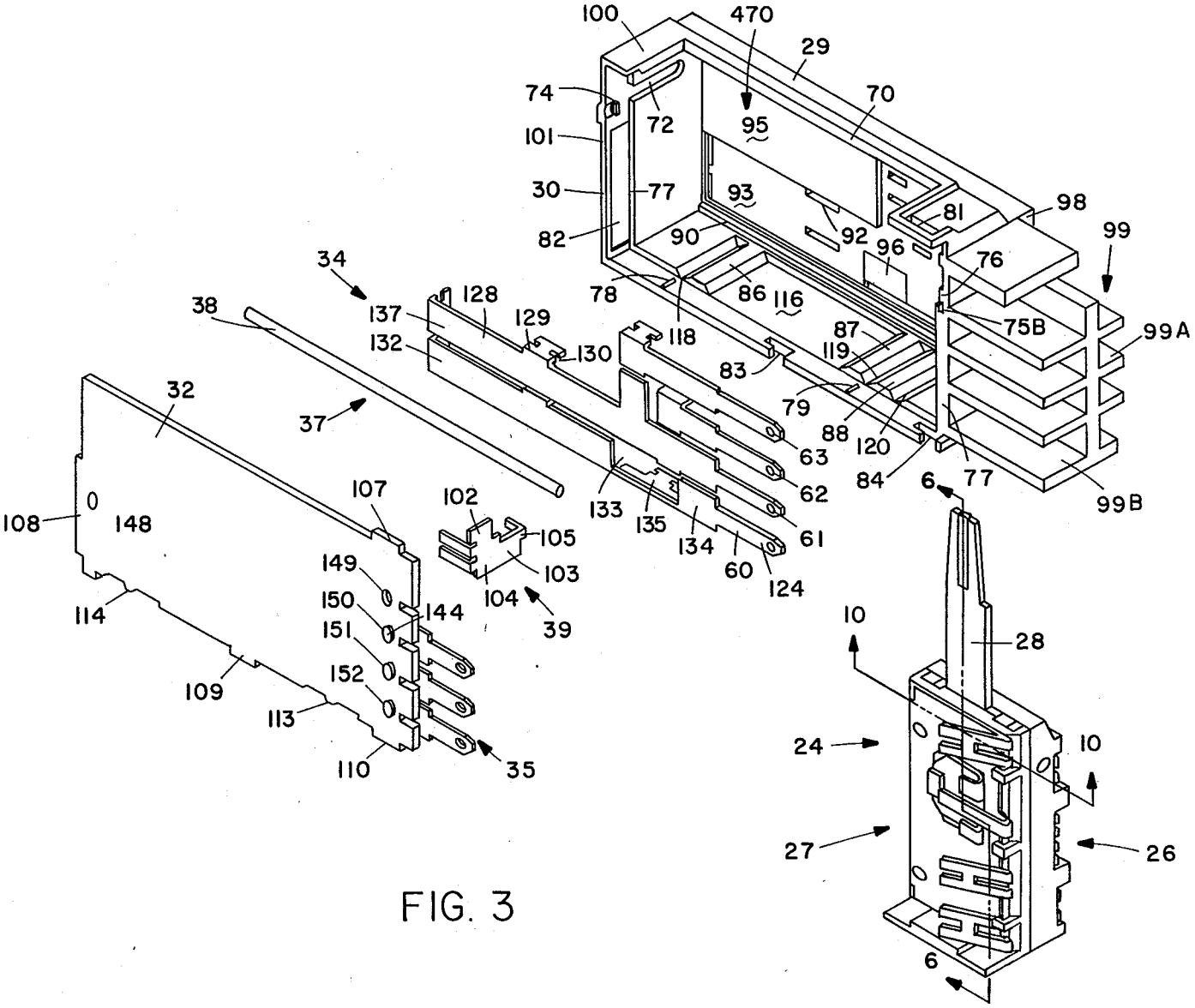
FIG. 3 is a partially exploded view of the switch of FIG. 2.
Figure 8:
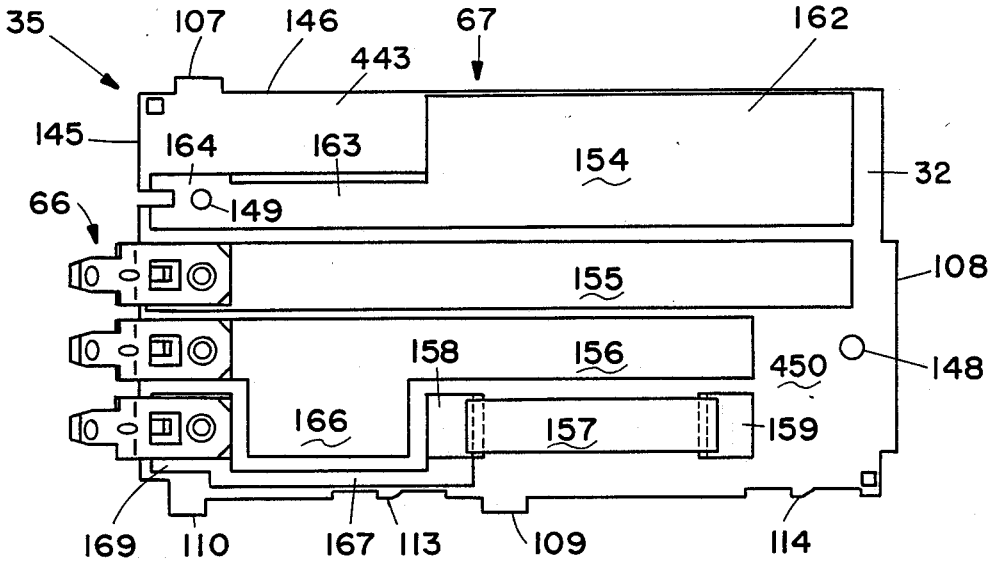
FIG. 8 is a plane view of the circuit board, trace side, of the switch of FIG. 2.

FIG. 3 shows an exploded perspective view of a switch 20 according to the invention. Switch 20 includes a contact carrier means 24 having a first contact means 26 and a second contact means 27 mounted on it and a lever means 28 for sliding it, a housing 29, having an open end 30, a cover means 32 for closing the open end 30, first terminal means 34, second terminal means 35, a stabilizing means 37, including a stabilizing bar 38, a connecting bus means 39 (FIG. 11) for electrically connecting the first and second terminal means and for holding the stabilizing bar 38 in place, and a plunger means 40 which as will be seen includes the lever 28. Contact carrier means 24 and contact means 26 and 27 are shown exploded in FIG. 4. Carrier means 24 includes: wash contact carrier 42; first housing portion 44; plunger means 40 which includes plunger 28, and springs 46 and 47; detent plunger 48; spring 49; and second housing portion 50. First contact means 26 includes wiper spring and contact members 53 and 54. Second contact means 27 comprises delay spring contact and wash bias member 56 and wash spring and contact member 57. First terminal means 34 (FIG. 3) includes park terminal 60, low terminal 61, high terminal 62, and B+terminal 63. Second terminal means 35 (FIG. 8) includes connecting terminals 66 and traces 67 mounted on cover 32 which is a circuit board.

Housing 29 comprises a roughly rectangular box integrally molded out of type N276 6/6 nylon, 15% glass, and 25% mineral filled and is shown in FIGS. 2, 3, 5 and 11. Housing 29 includes an open end 30, an aperture 70, channels 72 and 73, a projection 74, slots 75A and 75B, rib 76, rim 77, cover detents 78 and 79, slots 81, 82, 83 and 84, detent ramps 86, 87 and 88, rib 90, ten slots, such as 92, in wall 93, plateaus 95 and 96, four slots, such as 97 in side 98 (FIG. 11) and four each of terminal channels 99A and 99B. The housing 29 is roughly 2.540 inches long (not counting channels 99), 1.43 inches wide and 0.800 inches deep with a wall thickness typically about 0.05 to 0.10 inches. Aperture 70 is about 2 inches long and ⅜ inches wide. Channel 72 is U-shaped with a circular radius at the bottom of the U 0.095 inches in diameter centered 0.345 inches from top surface 100 and 0.490 inches from the front surface 101, and widening toward opening 30 at a 3° angle on each side of the slot. Slot 73 is of the same shape and similarly located in the opposite wall of housing 29. Slots 75A and 75B are located on either side of slot 73 and are sized to loosely receive sides 102 and 103 respectively of connecting bus member 104. Rib 76 is placed to lie behind and support finger 105 of connecting bus member 104 so that there is minimal play of bus member 104 in slots 75A and 75B in the horizontal direction in FIG. 5. Rim 77 is from 0.035 to 0.10 inches wide and together with the ends of detent ramps 86, 87 and 88 provides a surface to support cover 32. Slots 81, 82, 83 and 84 are sized to snugly receive flanges 107, 108, 109 and 110 respectively of cover 32. Cover detent ramps 78 and 79 are 0.015 inches high and 0.060 inches long and interact with detents 113 and 114 on cover 32 to hold the cover in place. Projection 74 serves as a stop to locate and hold precisely cover 32. Detent ramps 86, 87 and 88 extend about 0.030 inches above the surface 116 and drop down into grooves, such as 118, that are 0.050 inches deep between the top of the ramps. The ramps slope at typically 60°. The grooves 118, 119 and 120 are spaced 0.436 inches, 0.636 inches and 1.830 inches respectively from the outside left end of housing 29 in FIGS. 3 and 5. Rib 90 is about 0.050 inches high and acts as a stop for carrier 24 to prevent too much force being exerted on contact means 26. Slots 92 are typically 0.050 inches wide and 0.220 inches long on the side of surface 100 (FIG. 2) and slope inward at 15° so they are slightly longer on interior surface 93. Plateaus 95 and 96 are 0.020 inches high and provide smooth insulating surfaces over which the contacts of contact means 26 slide that are even with the surfaces of terminals 60–63. Slots 97 are sized to snugly and easily pass the ends of terminals 60–63. Channels 99A and 99B are each 0.295 inches wide by 0.750 inches long while channels 99A are each about 0.195 inches deep and channels 99B are each about 0.305 inches deep. These channels serve to protect the connectors of terminal means 34 and 35. Terminals 60–63 are each made of 0.020 inch thick #260 brass alloy, half hard, with a tensile strength of about 62,000 psi. Their connecting terminals, such as 124, are each 0.430 inches long by 0.110 inches wide, with a 0.048 inch diameter hole spaced about 0.060 inches from the end and tapered at 15° over this distance The bus portions of the terminals, such as 128, are 0.180 inches wide. The connecting flanges, such as 129, typically extend 0.150 inches from the back surface (in FIG. 3) of the bus portion 128, bend about a 0.010 inch radius at the juncture with the bus portion, are 0.200 inches wide and have a pair of notches, such as 130, that are each 0.060 inches deep, 0.040 inches wide at the outside end and the back edge (in FIG. 3) tapers in at 20°. The first edge of each notch 130 is parallel to the back surface of the bus portion 128 and located 0.070 inches from that surface. The bus portion of park terminal 60 has a section 132 1.36 inches long, a gap 133 0.540 inches long, and a section 134 0.265 inches long, with the portions 132 and 134 being connected by a bent back portion 135. The bus portion 128 of low terminal 61 (FIGS. 3 and 5) comprises a 2.165 inch section 137 and a 0.200 inch section 138 that extends 0.250 inches from section 137. The bus portion of high terminal 62 comprises a 0.535 inch section 139, and the bus portion of B+ terminal 63 comprises a 0.785 inch section 140.

Stabilizing bar 38 is a 0.094 inch diameter stainless steel rod 2.475 inches long and having a 0.010×45° chamfer on each end. Bar 38 is preferably type 303 free machining alloy and tumbled to a polished finish. Cover 32 (FIGS. 3 and 8) is a roughly rectangular piece of 0.062 inch thick General Electric PC075 TM laminate circuit board. Traces 67 are 1-ounce copper traces which are solder coated with a 60/40 solder except where noted below. Circuit board 32 is 2.450 inches long by 1.330 inches wide. Flanges 107 and 110 are 0.150 inches long and 0.050 inches wide and are centered 0.200 inches from the end 145 of the board. Flange 109 is the same size and centered 1.200 inches from the same end 145. Flange 108 is 0.680 inches long and 0.050 inches wide and centered 0.850 inches from the upper side 146. The detent members 113 and 114 are 0.060 inches long, one-half of which length is a slope down to an approximately 0.015 inch depth. The indentations on either side of detent members 113 and 114 are 0.150 inches long. The vertical edge of the detent members 113 and 114 is located 0.780 inches and 2.150 inches respectively from the end 145 of the board 32. The board 32 has five 0.067 inch diameter holes 148–152. Holes 148 and 151 are centered 0.850 inches from edge 146. Hole 148 is centered 2.350 inches from end 145 and holes 149–152 are centered 0.200 inches from the same end and spaced 0.250 inches from each other. The portion 162 of trace 154 begins 2.345 inches from end 145 and goes to 0.890 inches from the same end and is 0.440 inches wide. The portion 163 extends to within 0.350 inches of end 145 and is 0.130 inches wide. The portion 164 extends to within 0.030 inches of end 145. Trace 155 is 0.220 inches wide and extends from 2.345 inches from end 145 to 0.030 inches of the end. Trace 156 is 0.200 inches wide and extends from 2.02 inches from end 145 to within 0.030 inches, and has a portion 166 extending to within 0.040 of trace 167 and spaced 0.050 inches from traces 158 and 169. Trace 158 begins 0.890 inches from end 145 and extends 1.100 inches from the same end while trace 159 begins 0.770 inches from trace 158 and is 0.150 inches long. Both traces 158 and 159 are about 0.20 inches wide and are silver. Trace 157 is about 0.180 inches wide, overlaps traces 158 and 159 by about 0.04 inches and is made of carbon. Connecting terminals 66 are conventional #260 brass alloy connectors with the connecting ends similar to the ends of terminals 60–63 except 0.340 inches long and made of the same material. They are held to PC board 32 by tin plated brass rivets, such as 144, passing through holes 150–152. The connecting bus means 39 includes bus member 104, slots 75A and 75B and rib 76. Connecting bus member 104 is made from 0.01 inch thick #260 brass alloy with tensile strength of about 95,000 psi. Bus member 104 is shown in FIGS. 3, 11, 12 and 13. Bus member 104 includes spring fingers 105, 173 and 174 having contacts 175, 176 and 177, flange 179 and shoulders 181 and 182. Bus member 104 is 0.380 inches in the vertical direction in FIG. 12 from edge 185 to 186 and 0.490 inches in the horizontal direction from edge 187 to edge 188. Flange 179 is 0.050 inches by 0.100 inches. Shoulders 182 is 0.270 inches from edge 187 and 0.135 inches wide. Shoulder 181 is 0.330 inches wide. Shoulder 181 is 0.330 inches from edge 187 and 0.105 inches wide. Finger 105 is 0.080 inches wide while fingers 173 and 174 are 0.050 inches wide, spaced 0.030 inches apart edge-to-edge and the edge of finger 173 farthest from edge 186 of the connector spaced 0.215 inches from that edge. The fingers 105, 173 and 174 make a curve of inside radius 0.030 inches at the juncture with base 190, and are 0.180 inches high from the bottom side in FIG. 13 of base 190 to the center of curvature of contacts 175, 176 and 177. Contacts 175, 176 and 177 each are curved in an outer radius of 0.050 inches. The connecting member 104 is 0.560 inches horizontally from the outer edge of contact 175 to the outer edges of contacts 175 and 176 in working position and 0.620 inches in the free position shown in ghost in FIG. 13.

Figure 4:
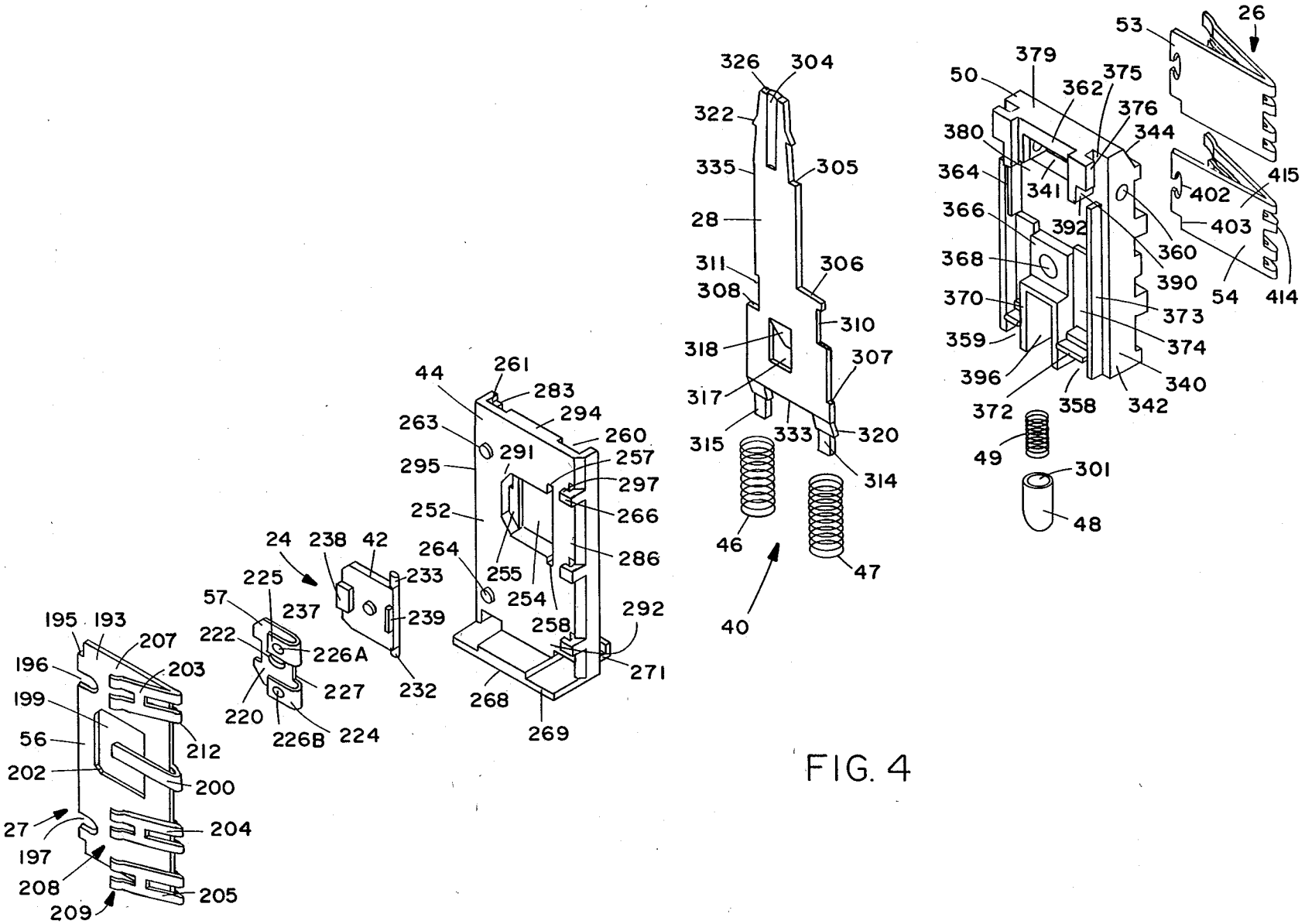
FIG. 4 is an exploded view of the contact carrier and its contacts of the switch of FIG. 3.
Figure 5:
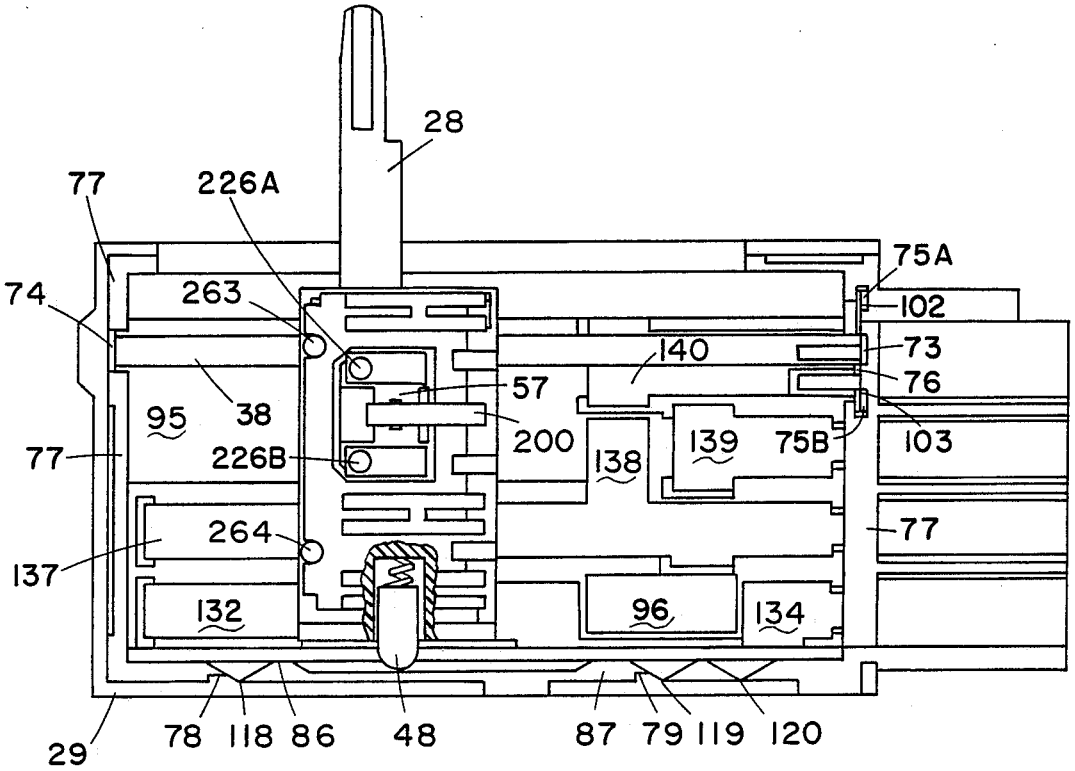
FIG. 5 is a view of the switch of FIG. 2 with its cover removed.
Figure 6:
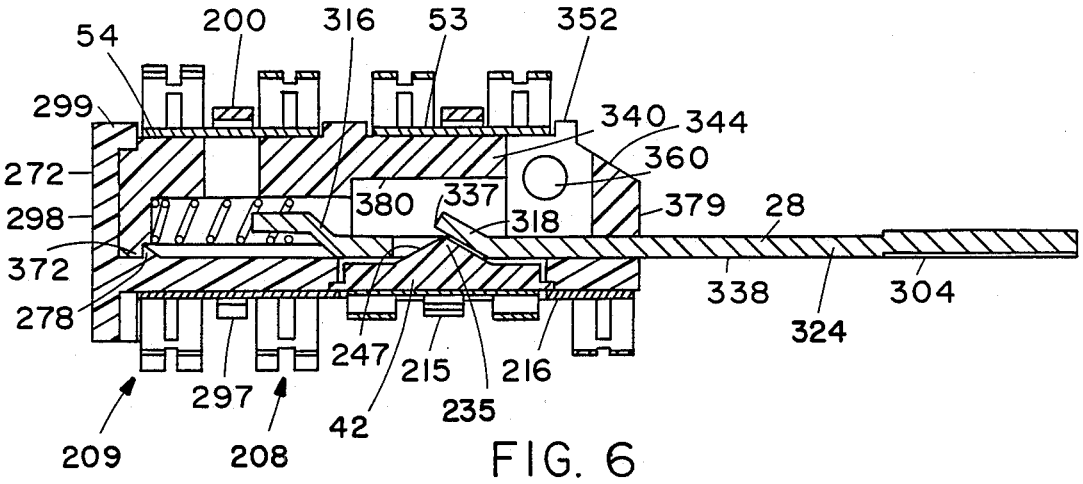
FIG. 6 is a cross section of the preferred embodiment of the contact carrier and contacts taken through line 6—6 of FIG. 3.
Figure 7:
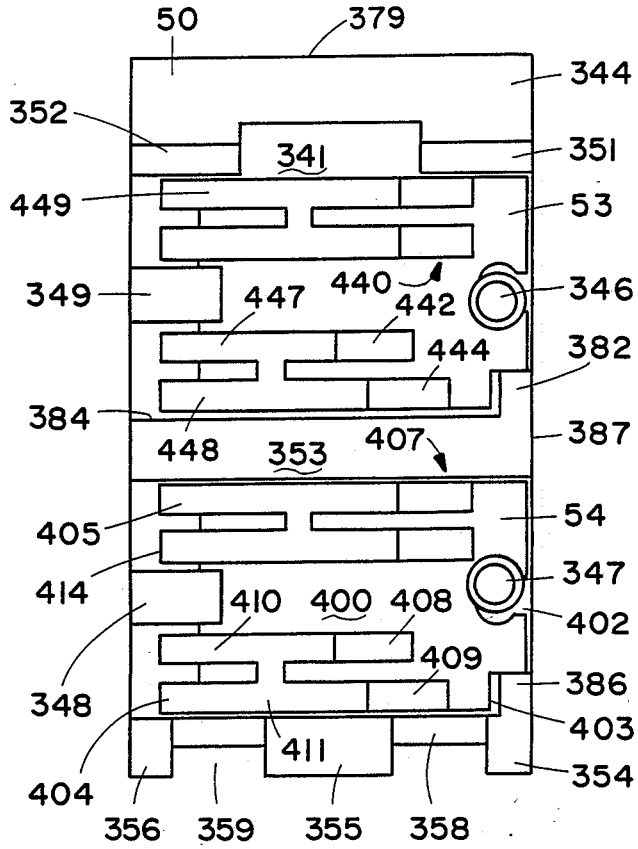
FIG. 7 is a plane view of the normal power switch side of the contact carrier of FIG. 6.
Figure 9:
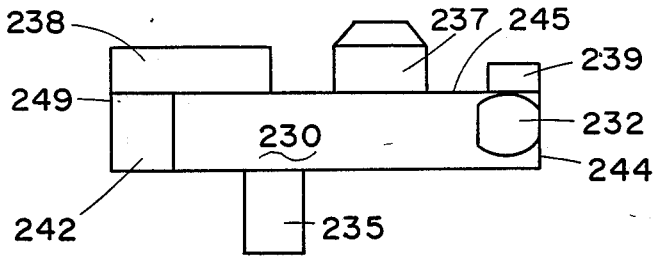
FIG. 9 is a plane side view of the wash contact carrier of FIG. 6.
Figure 10:
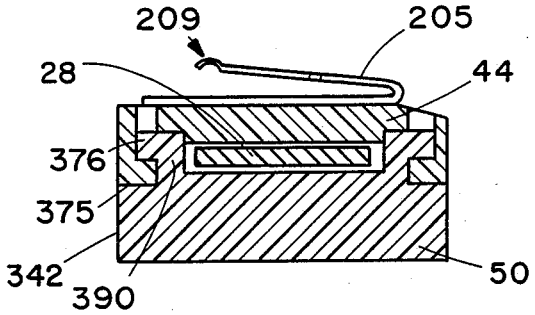
FIG. 10 is a cross section of the contact carrier of FIG. 6 taken through lines 10—10 of FIG. 3.

Turning now to the parts shown exploded in FIG. 4, delay spring—contact—and wash bias member 56 comprises a base member 193 having notches, such as 195 in each of two corners, slots 196 and 197 and aperture 199. Member 56 also includes wash carrier bias means 200, and spring blades pairs 203, 204 and 205, having contacts 207, 208 and 209 respectively. The member 56 is made out of 0.012 inch thick #688 copper alloy, half hard, tensile strength about 105,000 psi. Base member 193 is 1.060 inches by 0.535 inches. Notches 195 are 0.050 inches square. Slots 196 and 197 are 0.070 inches wide 0.080 inches deep with the inner end curbed in a full 0.035 inch radius. The centers of slots 196 and 197 are located 0.680 inches apart and 0.180 inches from the lower and upper edges of member 193 in FIG. 4. Aperture 199 is 0.340 inches by 0.476 inches with the two corners, such as 202, away from bias means 200 having a 0.050×45° chamfer. The upper edge of aperture 199 in FIG. 4 is located 0.412 inches from the upper edge of base member 193 while the edge of aperture 199 nearest the bias means 200 is located 0.440 inches from the edge of member 193 along slots 196 and 197. Each of the blade pairs 203, 204 and 205 are an H-shaped with each leg of the H 0.050 inches wide and 0.030 inches between the legs. The ends of the blades 203, 204 and 205 extend 0.070 inches from base member 193 and the cross-bar of the H is 0.040 inches wide and begins 0.250 inches from the bent ends, such as 212, of the blades. The bends, such as 212, are curved with an inner radius of 0.015 inches. The contacts 207, 208 and 209 are curved with an outside radius of 0.060 inches along an 80° arc. The center of the arc of the contacts 207, 208 and 209 is located 0.120 inches from the inner ends of slots 196 and 197 in working position. The contacts are spaced 0.170 inches from the back surface (FIG. 4) of base member 193 in free position and 0.130 inches in working position. Bias member 200 is 0.080 inches wide and centrally located over aperture 199. Member 200 also extends 0.070 inches from member 193 and is bent in a 0.015 inch radius. The inner distal tip 215 (FIG. 6) is located 0.430 inches from the end of its bend and 0.010 inches above the surface 216 of member 193 in its free position. Wash spring and contact member 57 is made of the same material as member 56 except it is of 0.008 inch thickness. Member 200 has a generally C-shaped base member 220, a hole 222 and a pair of spring blades and contacts 226A and 226B. The "top" and "bottom" of the C are each 0.100 inches wide by 0.220 inches long with the outer tips having a 0.050×45° chamfer. The "back" of the C is 0.200 inches by 0.140 inches in diameter. Hole 222 is 0.070 inches in diameter and centered 0.060 inches from the back edge 227 of the C and 0.100 inches from the top and bottom of the C. Spring blades 224 and 225 are also 0.100 inches wide and bent in a full radius so that the blades 224 and 225 are parallel to base 220. The contacts 226A and 226B are each 0.080 inch diameter dimples having a 0.050 inch spherical radius with the outer surface raised 0.020 inches above the outer surface of the blades 224 and 225. The dimples 226A and 226B are centered 0.150 inches vertically in FIG. 5 from the center of hole 222 (which places them centered vertically in blades 224 and 225) and 0.085 inches horizontally from the center of hole 222, which places their center 0.055 inches from the distal ends of the blades. Wash contact carrier 42 is shown best in FIGS. 4, 6 and 9. Carrier 42 is made of N-276 black 6/6 Nylon TM plastic filled with 15% glass and 25% mineral. Carrier 42 comprises a base member 230, a pair of pivot pins 232 and 233, a projection 235, a post 237, and wash spring locator flanges 238 and 239. Base member 230 is roughly rectangular, 0.280 inches wide by 0.420 inches long with 0.040×45° chamfers, such as 242, on the ends away from pivot pins 232 and 233. Pivot pins 232 and 233 are 0.050 inches long, have two flat sides spaced 0.039 inches apart and two curved sides that are spaced 0.040 inches apart and curved about a 0.030 inch radius. The axis of each pin is located 0.020 inches from the surface 244 of base member 230 and 0.020 inches from surface 245. Projection 235 is V-shaped as can be seen best in FIG. 6. Projection is 0.040 inches wide in the horizontal direction in FIG. 9, and extends 0.130 inches from surface 245 with sides, such as 247, making a 60° angle with the vertical in FIG. 6 and the tip of the V rounded in a 0.010 inch radius. Post 237 is 0.062 inches in diameter and 0.047 inches high with a 0.015×45° chamfer on the end. It is centered 0.175 inches from the surface 249 and centered between the sides of member 230 in the direction into the paper in FIG. 9. Flange 238 is 0.180 inches long by 0.090 inches wide by 0.030 inches high. Flange 238 is centered on base 230 in the direction into the paper in FIG. 9. Flange 239 is 0.190 inches long by 0.035 inches wide by 0.020 inches high and also centered in the direction into the paper in FIG. 9. First carrier housing portion 44 is shown in FIGS. 4, 5, 6 10 and 14 and is made of Nylon TM 6/6 plastic, 40% mineral filled. Portion 44 includes a base member 252 having an aperture 254 with a cross member 255, bearing channels 257 and 258, and grooves 260 and 261. Housing portion 44 also comprises posts 263 and 264, three fingers such as 266, flange 268, legs 271 and 272, rails 274 and 275, catches 277 and 278, side bars 280 and 281, tongues 283 and 284. Plunger 48 also includes a sloped surface 286 and seven slots, such as 287, 288 and 289 which do not function within the apparatus except in manufacture. The sloped surface 286 permits the contact member 56 to be slanted in under fingers 266 during assembly and the seven slots are created in the molding process in order to form the fingers, legs and tongues. Base member 252 is 0.070 inches thick, 0.650 inches wide and 1.168 inches long. Aperture 254 is 0.430 inches long and 0.330 inches wide, having a 0.050×45° chamfer, such as 291 at each corner opposite channels 257 and 258. Cross member 255 is 0.050 inches wide, 0.025 inches thick and extends across the aperture flush with surface 290 to provide a stop for wash carrier 42 to prevent it from falling through the aperture 254. Bearing channels 257 and 258 are formed at opposing sides of aperture 254 0.45 inches deep and wide and extend 0.05 inches away from the side of aperture 254. Flange 268 is 0.110 inches high with a thicker portion 0.090 inches thick in the center and a thinner portion 269 0.048 inches thick at either side. The thicker portion is about 0.242 inches long. Posts 263 and 264 are 0.062 inches in diameter and 0.050 inches high with a 0.010×45° chamfer on the ends. They are centered 0.205 inches and 0.885 inches respectively from end 294 of member 44 and 0.060 inches from the edge 295 of the member. There are three fingers 266 which are each L-shaped with the portion extending perpendicular to the surface 292 of member 252 extending 0.060 inches from the surface 292 and being 0.060 inches thick in the horizontal direction of FIG. 14 and 0.100 inches wide in the other direction. The portion 297 parallel to surface 292 is 0.145 inches long, 0.060 inches wide, and 0.03 inches thick at the top, the interior surface sloping toward the perpendicular portion and toward surface 292 to meet the perpendicular portion 0.015 inches above the surface. Legs 271 and 272 each have an upright portion 298 and an overhang portion 299. The upright portion 298 is 0.20 inches long, 0.048 inches thick and the width (in the vertical direction in FIG. 14) tapers from 0.115 inches wide at the end away from surface 290 at a 2° angle at each side. The outer edge of each tip is located 0.251 inches from the centerline of member 252. The overhang portion 299 is 0.050 inches thick in the vertical direction in FIG. 6 and overhangs by 0.045 inches. Side bars 280 and 281 each extend 0.085 inches above surface 290 and are 0.037 inches thick. Rails 274 and 275 extend 0.020 inches above surface 290 and extend 0.034 inches from side bars 281 and 280 respectively. Grooves 260 and 261 are each 0.105 inches wide, 0.020 inches deep into surface 290, and 0.320 inches long. Tongues 283 and 284 are each 0.050 inches thick and extend 0.040 inches from side bars 280 and 281 respectively. Wash return springs 46 and 47 are identical and are made of 0.02 inch diameter music wire with a phosphorous pre-coat. The coils are 0.115 inches in outside diameter and 0.075 inches in inside diameter and they have a free length of 0.400 inches and a solid length of 0.125 inches. At 0.150 inches length they each exert a bias force of 225 grams. Detent plunger 48 is a bullet-shaped member 0.275 inches long, 0.156 inches outside diameter and having an inner bore 301 of 0.098 inches diameter with the inner circumference of the bore rounded in a 0.015 inch radius and the outer end having a 0.015×45° chamfer. The "bullet" end has a full spherical radius of 0.078 inches. It is made of free machine brass. Detent spring 49 is made of 0.010 inch diameter pre-tinned music wire. The coils have an outside diameter of 0.090 inches and there are at least six active coils. Spring 49 has a free length of 0.27 inches and a working length of 0.200 inches with a bias force of 90 grams at the working length. Lever 28 is made of 0.041 inch thick c1010 cold rolled steel #2 temper, Rockwell B 70–85. Lever 28 includes groove 304, shoulders 305–308, indentations 310 and 311, fingers 314 and 315, slot 317, ramp 318, two flanges, such as 320, and two projections, such as 322. The lever 28 is 0.450 inches long from end 326 to shoulder 305, 0.790 inches further to shoulders 307 and 308, 0.355 inches further to fingers 314 and 315 and the fingers are 0.180 inches in length. The lever's width is 0.150 inches just before shoulder 305 and widens to 0.200 inches at the shoulder 305. It tapers at 3° from end 326 until 0.125 inches before shoulder 305 where it reaches the 0.150 inches mentioned above. The projections 322 extend out to 0.160 inches between their tips and slope downward and out (in FIG. 4) at 45°. Groove 304 is 0.060 inches wide and radiused so it dimples the surface of the member about 0.012 inches. The member 28 widens to 0.395 inches at shoulder 306, and indentations 310 and 311 each indent 0.010 inches and begin 0.108 inches from shoulder 306. Flanges 320 each extend out 0.010 inches, begin 0.245 inches from shoulders 307 and 308 and extend 0.02 inches past end 333. Fingers 314 and 315 each are 105 inches wide for a 0.090 inch portion 316 (FIG. 6) then the outer edges indent 0.015 inches to the ends and the inner edges indent about 0.016 inches then slope outward narrowing the fingers to about 0.062 inches wide at the top. The member 28 is lanced to form slot 317 and ramp 318. Slot 317 is 0.320 inches long and 0.100 inches wide and the edge closest to side 335 is 0.070 inches from the side. Ramp 318 angles outward at 17.5 degrees so that its tip 337 extends 0.110 inches vertically in FIG. 6 from surface 338. The end is trimmed so that it is 0.245 inches in the horizontal direction in FIG. 6 from the beginning of the bend to the furthest horizontal extension of the tip. Fingers 314 and 315 are also bent in the same direction as ramp 318, as best seen in FIG. 6. The angle of the bent portion is 45° with body portion 324 and the distance the distal end is moved vertically in FIG. 6 is 0.042 inches. The edges of the shoulder and other sharp corners are rounded with about a 0.012 inch radius and the member 28 is tumbled to give it an overall smooth finish. Second housing portion 50 is made of Nylon TM 6/6 plastic with 40% mineral content. Housing portion 50 is shown in FIGS. 4, 6, 7 and 10. Housing portion 50 includes a base member 340 having an aperture 341 and side walls, such as 342, a sloped end 344 (FIG. 7), posts 346 and 347, fingers 348 and 349, flanges 351–356, (FIG. 7), channels 358 and 359, bearing channel 360, benches 362, 364 and 366, core 368, detent housing 370, catches, such as 372, rails such as 373, spring chambers, such as 374, grooves such as 375 and tongues such as 376. Base member 340 is 0.090 inches thick, 0.650 inches wide and 1.165 inches long and slopes at 344 the thickness of member 340 up to flanges 351 and 352 at a 30° angle to a line parallel to the long dimension of base member 340. Aperture 341 is 0.290 inches long and 0.180 inches wide, passes entirely through member 50 and its lower edge in FIGS. 4 and 7 is located 0.080 inches from a line parallel to the axis of channel 360. Channel 360 is cylindrical 0.0975 inches in diameter, and its axis is located 0.205 inches from the end 379 of member 50 in the horizontal direction in FIG. 6 and even with the surface 380 of member 340 in the vertical direction. Flange 353 is 0.030 inches high, 1.09 inches wide across its main portion with a foot 382 that is 0.050 inches square. Its edge 384 is located 0.370 inches in the vertical direction in FIG. 7 from the plane of the axis of channel 340. Flanges 352 and 351 are 0.050 inches wide, 0.030 inches high, 0.180 inches long, and located 0.390 inches from flange 353. Flanges 354 and 356 are also 0.030 inches high and located 0.390 inches from flange 353. Flange 356 is 0.090 inches long by 0.073 inches wide while flange 354 has a portion the same width and length as flange 356 plus a foot 386 0.050 inches square. Flange 355 is 0.09 inches wide, 0.030 inches high, and its other dimensions are determined by channels 358 and 359 discussed below. Posts 346 and 347 and fingers 348 and 349 are of the same dimensions as posts 263 and 264 and fingers 266 on member 44, except fingers 348 and 349 are 0.090 inches wide in the vertical direction in FIG. 7. The centers of posts 346 and 347 are located 0.060 inches from edge 387 and 0.195 inches and 0.655 inches respectively from the plane of the axis of channel 340. Except for two slots under fingers 349 and 348 which are formed due to well-known molding considerations, the interior side of member 50 facing toward the front in FIG. 4 is symmetrical about a vertical plane through its center, and thus each part has its counterpart on the other side. Therefore only one of each pair of parts will be discussed. Benches 362, 364 and its counterpart and bench 366 extend 0.120 inches from surface 380 and form the bearing surface for lever 28. Bench 362 is C shaped with the back of the C aligned with surface 379 being 0.405 inches long and its width determined by aperture 341 discussed below, and the arms of the C extending the 0.180 inches along the sides of aperture 341 and being 0.058 inches wide. Bench 364 is 0.05 inches wide by 0.320 inches long, and bench 366 is 0.185 inches wide by about 0.260 inches long and has a core 368 of about 0.10 inches diameter. Side walls, such as 342, are 0.085 inches high and about 0.073 inches thick with rails such as 373 about 0.030 inches wide extending another 0.055 inches further from surface 380. While the side walls, such as 342 extend the length of the member 50, the rails extend only to grooves 375. Grooves 375 and tongues 376 are seen in cross section in FIG. 10. They extend 0.046 inches into one another and in the vertical direction in FIG. 10. Groove 375 is 0.054 inches between the top of wall 342 and the bottom of tongue 376 and tongue 376 is 0.50 inches in the vertical direction. Flange 390 which supports tongue 376 is about 0.06 inches wide in the horizontal direction in FIG. 10 and 0.305 inches long in the vertical direction in FIG. 4. Tongue 376 is 0.140 inches long in the same direction. A channel 392 0.130 inches long extends from tongue 376 to rail 373. Detent plunger housing 370 has a wall 0.050 inches thick in a U shape with a cavity 396 0.275 inches long in the vertical direction in FIG. 4 and 0.162 inches wide with a depth of 0.160 inches and which is rounded at the bottom about a 0.081 inch radius. Catch 372 is best seen in cross section in FIG. 6 and is a ramp with a vertical wall extending downward in the FIG. for about 0.025 inches and located 0.860 inches from the plane of the axis of channel 360, extending horizontally for a short distance then sloping back up the same vertical distance at 45° to a point 0.913 inches from the same plane. Channels 358 and 359 are dimensioned to snugly receive legs 271 and 272 of member 44 with the outside surface of the legs flush with the outer surfaces of flanges 354, 355 and 356. Chamber 374 is 0.125 inches wide and 0.425 inches long and a depth of 0.100 inches between the top edge of rail 373 and the back of the chamber. Wiper spring and contact members 53 and 54 are identical and thus only member 54 will be described. Member 54 is shown in FIGS. 4, 6 and 7. Member 54 is made of 0.016 inch thick #688 copper alloy, half hard, tensile strength about 105,000 psi. Member 54 comprises a plate 400 having a slot 402 and a notch 403 and two pairs of contact blades 404 and 405 with contacts 407 on pair 405 and contacts 408 and 409 on pair 404. Plate 400 is 0.380 inches wide by 0.550 inches long . Slot 402 is defined by two radii of 0.031 inches taken about centers which are 0.049 inches from the right end of plate 400 in FIG. 7, the lower one of which is 0.156 inches from the lower edge of plate 400 and the upper one of which is 0.068 inches further from the same edge. The upper horizontal edge that define the slot opening is 0.010 inches vertically above the upper radius center while the lower horizontal edge is 0.010 inches below the lower center. Notch 403 is 0.060 inches square. The two blades in pair 405 are identical and each are 0.050 inches wide with 0.030 inches between them. They are in the form of a H with the cross bar 0.040 inches wide and the length of the blades 405 defined as follows: the left ends of the blades 405 in FIG. 7 are 0.520 inches horizontally from the left end of slot 402, the vertical center line of the cross bar of the H being 0.230 inches from the left end of the blades and the vertical centerline of the contacts 407 being 0.070 inches horizontally from the left end of slot 402. The contacts 407 are each defined by a 0.660 inch radius which arcs to 45° on either side of the vertical contact centerline and turned back in a 0.015 inch radius at either end of the arc to blend with the blade at one end of the arc and return to a line parallel to the blade at the other end. The curve 414 at the end of the blades is about a 0.015 inch radius. The blades 410 and 411 of the blade pair 404 are of different lengths, the vertical centerline of contact 408 being 0.170 inches horizontally from the vertical line along the left side of slot 402 and that of contact 409 being 0.120 inches from the same vertical line. Otherwise the dimensions of blades 404 are the same as blades 405 except that the vertical midline of the cross bar of the H is 0.180 inches from the left end of the blades. The grain direction is horizontal in FIG. 7. The free height of the contacts 407, 408 and 409 above the surface 415 of plate 400 that contacts member 50 is 0.140 inches while the working height is 0.100 inches.

Figure 2:
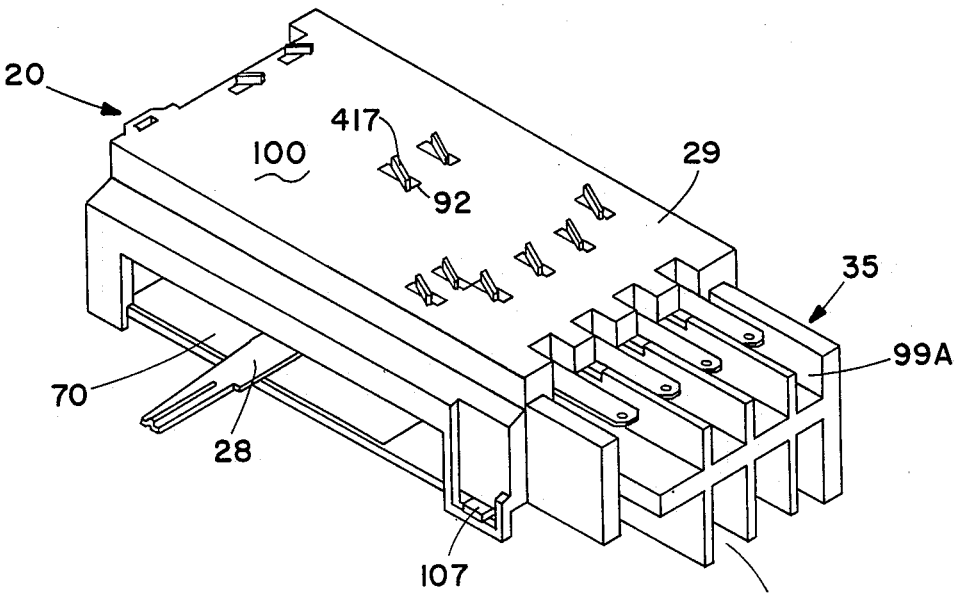
FIG. 2 is a perspective front view of the preferred embodiment of an automotive switch according to the invention.
Figure 11:
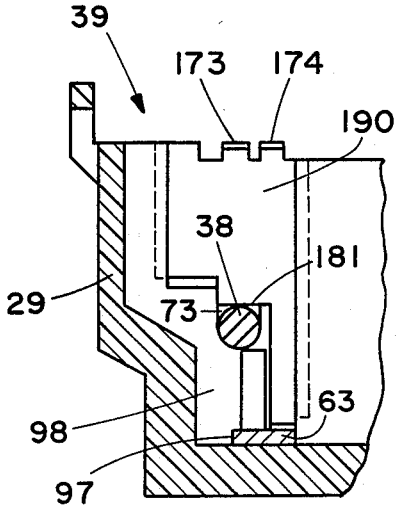
FIG. 11 is a detail of the switch of FIG. 2 showing the preferred connecting bus.
Figure 12:
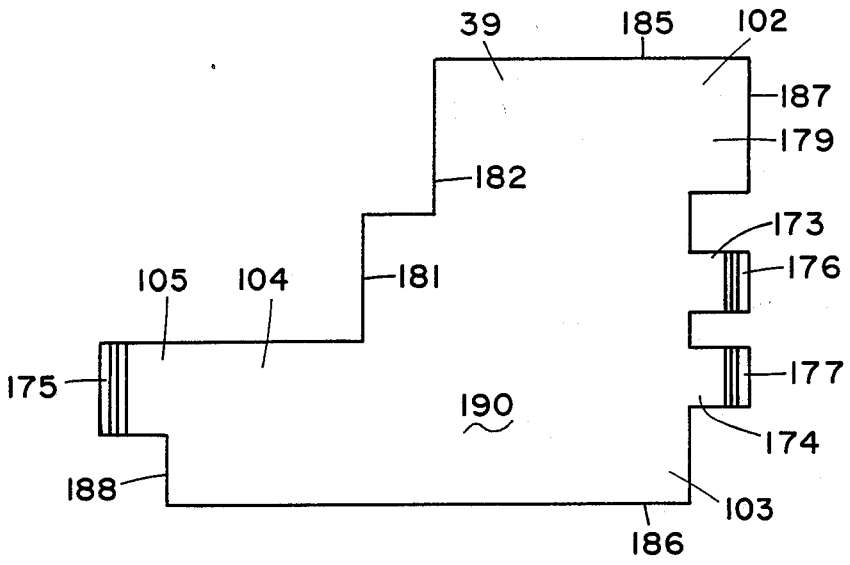
FIG. 12 is a plane view of the preferred embodiment of the connecting bus of the switch of FIG. 2.
Figure 13:
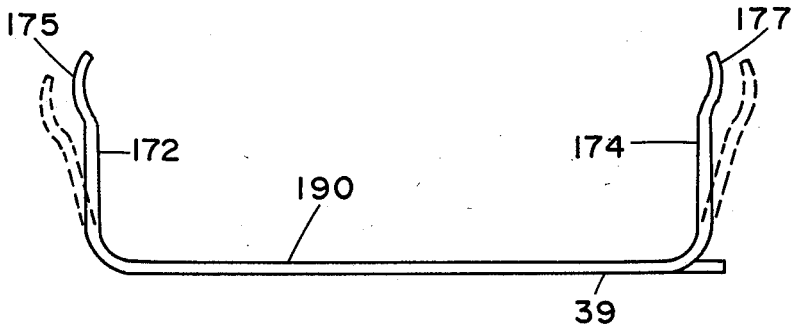
FIG. 13 is a side view of the connecting bus of FIG. 12.
Figure 14:
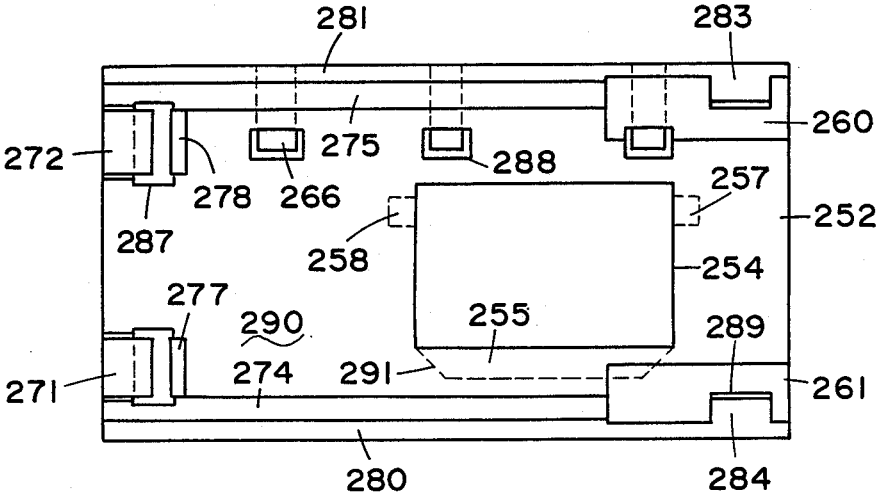
FIG. 14 is a plane view of the low power switch side of the contact carrier of FIG. 6.

The switch assembly 20 is assembled as follows. The terminals 60–63 are placed in housing 29 in the arrangement shown in FIGS. 3 and 5 with flanges, such as 129, passing through the slots, such as 92, and the portion 417 of the flanges 129 beyond the slots 130 are twisted about 30° as shown in FIG. 2 to lock the terminals in place. Terminals 35 are riveted to circuit board 32. The wash contact means 57 is seated on the wash carrier 42 with hole 222 over post 237 and the "back of the C" between flanges 238 and 239. The post 237 is then spin staked to fasten the parts together. The carrier 42 is placed in aperture 254 in carrier housing member 44 with pins 232 and 233 in bearings 258 and 257 respectively and the opposite edge of carrier 42 resting on cross bar 255. Contact means 56 is then placed on member 44 as shown in FIG. 5 with posts 263 and 264 in slots 196 and 197 and the posts are spin staked to attach the base member 193 to member 44, with the edges of the base member 193 about aperture 199 covering the pins 232 and 233 on the wash carrier 42 to hold it in place. Likewise, contact means 53 and 54 are placed on and spin staked to carrier housing member 50 as shown in FIG. 7. The ramp 318 of slide lever 28 and the surfaces that contact members 44 and 50 are lubed with a light grease such as Nye 723G (see below). Springs 46 and 47 are then placed in chambers such as 374 on either side of housing 370 in member 50 and the fingers 314 and 315 of lever 28 are inserted into the spring coils and the lever placed on benches 362, 364 and 366 as shown in FIG. 6. The member 44 is then placed on member 50 with sidewalls 280 and 281 mating with sidewalls, such as 342, and rails 274 and 275 on member 44 meeting with the corresponding rails 373 on member 50 and tongues 283 and 284 on member 44 passing through channels, such as 392, on member 50. The members 44 and 50 are then slid in the horizontal direction in FIG. 6 with the ramps of catches such as 372 on member 50 riding up the ramps of catches 277 and 278 on member 44 until they snap in and lock as shown in FIG. 6. Note that the overhang such as 299 on legs 271 and 272 also fits into channels 358 and 359 respectively which prevents the members 50 and 44 from separating as the catches ramp up on one another. The detent plunger 48, the bus portions such as 128 of terminals 34 and the areas of housing 29, such as 95 and 96, that contact the contact means 26, and the traces 67 on circuit board 32 are lubed with a light grease such as Nye 723G available from William F. Nye, Inc., New Bedford, Mass., and the stabilizer bar 38 is lubed with a viscous grease, such as Nye 779. The viscosity at 210° F. is preferably 600 centistokes. Spring 49 is placed in bore 301 of detent plunger 48 and the two are placed in the cavity 396 of detent housing 370. Bar 38 is slid through channel 360 in carrier 24 and this assembly is placed in housing 29 with the ends of bar 38 sliding into slots 72 and 73. Connecting bus 104 is then placed in slots 75A and 75B as shown in FIG. 11 with shoulder 181 holding bar 38 in place and then cover 32 is attached to housing 29 as follows.. flange 107 is slipped into slot 81 and flanges 109 and 110 are snapped into slots 83 and 84. The cover is then slid to the left with respect to the housing in FIG. 3 which causes flange 108 to enter slot 82 as detent members 113 and 114 ride up detent ramps 79 and 78 respectively and snap in behind the ramps to lock the cover in place. The wiper and wash switch assembly 20 is thus entirely assembled with no fasteners other than rivets 144. The assembly may then be placed in a module such as 10 and covered with a cover such as 18 and a knob such as 21 attached to lever member 28 to use the switch assembly 20.

The switch assembly 20 according to the invention is operated as follows. The B+ terminal is connected to the positive battery voltage of the automobile. The park terminal 60 is also connected to this voltage. The low terminal 61 is connected to one set of windings in the wiper motors that run the wipers at low speed while the high terminal 62 is connected to another set of windings in the wiper motors that run the wiper at a higher speed. When lever 28 is in the far left position in FIGS. 1 and 2, contacts 440, 442 and 444 of contact member 53 (FIG. 7) contact insulating area 95 and no power is transmitted through them. This remains so as the lever 28 is moved to the right until the contacts 440 approach section 140 of the B+ bus 63 (FIG. 5). At this point detent plunger 48 begins to ride up detent ramp 87 which provides a tactile indication of the approach of the transition between the interval wiper function (see below) and the low wiper speed. At this position the contacts 442 and 444 will already have reached section 138 of low terminal 61. Therefore, the low speed of the wiper will be activated as soon as contacts 440 reach section 140 of B+ bus 63, at which point the wiper motors will directly operate through the circuit comprising terminals 61 and 63 and contact member 53. Also, at this point the detent plunger 48 clicks into groove 119 giving a tactile and audible indication of the low wiper speed being engaged. When lever 28 is moved further to the right, contact 442 contacts section 139 of high terminal 62 which runs the wipers at their high speed directly through the circuit comprising terminals 62 and 63 and contact member 53. Detent plunger 48 also rides up ramp 88 and clicks into groove 120 to give tactile and audible indications of the high wiper speed being engaged. Note that the different lengths of blades 447 and 448 cause the high circuit to turn on before the low turns off, which assures there will not be a break in operation as the gap between sections 138 and 139 is crossed. At the far left position of lever 28, contacts 407 of member 54 will contact section 137 of low terminal 61 and contacts 408 and 409 will contact section 132 of park terminal 60. This will activate the park circuit which fully retracts the wipers below the windshield at the low wiper speed. Thus the wipers will park whenever the switch lever 28 is moved to the off position. The contacts 407, 408 and 409 will remain in contact with the terminals stated above and the park function continues to operate over the interval wiper function area, which will be discussed below. When the insulating area 96 is reached by wipers 408 and 409, the circuit through contact member 54 is interrupted and the park function no longer operates. Note that because blades 410 and 411 are shorter than blades 449, the park circuit will open before the low circuit closes, thus preventing a short via the low terminal 61. Turning to the operation of the low power side of the switch, in the far left position of lever 28 the contacts 203 (FIG. 4) contact the trace 154 (FIG. 8) which is connected to the B+bus 63 via connecting bus member 104. Contacts 208 and 209 are contacting insulating area 450 of circuit board 32 and no current will flow. As lever 28 is moved to the right, contacts 209 will contact trace 159 and contacts 208 will contact trace 156. This will output a low power signal to a microprocessor which will turn on the interval wipe function. In the interval wipe area, the resistance 157, the contacts 208 and 209, together with trace 156 act as a rheostat with the contacts 209 moving across the resistance 157 and picking progressively less resistance as the lever 28 is moved to the right, and decreasing the interval of the wipe. Also as the contacts 208 and 209 reach the traces and 159 respectively, the detent plunger 48 clicks in and out of the groove 118 giving an audible and tactile indication of the interval wipe function being engaged. When lever 28 is moving in the right to left direction, this same detent surface provides an audible and tactile indication of the off position being reached. When contacts 209 reach area 158, the resistance 157 is no longer in the circuit and the minimum wipe interval is activated. Any further movement of lever 28 to the right will cause the contacts 207 to enter area 443 of circuit board 32 which is insulating which will result in no current flowing through member 56 and the interval function will cease to operate while the low and high wiper functions operate as described above. If plunger means 40 is operated by pressing lever 28 in at any position of the carrier means 24 in the housing 29, then projection 235 rides up ramp 318 which causes wash carrier 42 to move outward, pivoting about pins 232 and 233. This causes contact 226A to contact trace 154 and contact 226B to contact trace 155. This closes a circuit through traces 154 and 155 and wash contact member 57 which causes a microprocessor to activate the wash function.

Relating the above to the claim language below, it is seen that the backside 470 of the housing 29 is substantially flat. By "substantially" is meant that the side is sufficiently flat to allow carrier means 24 to slide between it and the cover 32 without binding. The lever means 17 comprises knob 21 and lever 28. The stabilizing means 37 includes stabilizing bar 38, slots 72 and 73 and the parts of the housing 29 which support this structure.

A feature of the invention is that the electrical load carried by the circuits including contact means 26 and terminals 34 carries a significantly higher load than the circuits comprising contact means 27 and traces 67. By significantly higher is meant that the load is at least three times higher. In the preferred embodiment the load across the high and low terminals 62 and 61 is 7 amps and 5 amps respectively, while the load across the interval wipe traces 156 and 157 is about 1 amp.

Another feature of the invention is that the stabilizing means 37 transmits any forces not along the direction of the bar 38 directly to the housing 29. This prevents these forces from being exerted on the carrier means 24 and the contact means 26 and 27. This results in a smoothly operating switch despite the small size and the difference in strength and function in the two sides. An important element of this feature is that the bar is made of highly finished metal. It should be clear that "highly finished" surface means one that has been treated, such as being tumbled, to provide a polished surface.

A further feature of the invention is its simplicity. Each part, such as the backside 470, the carrier means 24 and the cover 32 performs several functions. Thus a relatively complex switch is made up of only a few parts. Moreover, none of these parts except rivets 144 are separate fasteners. This results in a switch that is inexpensive to manufacture.

A novel multi-circuit switch combining both low and normal power circuits and including many other features and advantages has been described. It is evident that those skilled in the art may now make many modifications and uses of the specific embodiment described without departing from the inventive concepts. For example, many other dimensions, shapes and materials may be used for the parts. Other features may be added, or it may be used by itself or incorporated in other module designs. Consequently the invention is to be construed as embracing each and every novel feature and novel combination of features present in the switch described.

What is claimed is:

1. A multi-circuit electrical switch comprising:

a housing having at least one substantially flat side and an open end opposite said flat side;

bus bar means mounted on the inner surface of said flat side;

circuit board means for closing said open end of said housing and having a trace thereon; and a contact carrier slidably located between said flat side and means for closing, said contact carrier comprising:

first contact means mounted on a first side of said contact carrier for contacting said bus bar means;

second contact means mounted on a second side of said contact carrier opposite said first side for contacting said trace; and lever means for manually sliding said carrier to cause said first and second contacts to contact said bus bar and said trace; and said switch further comprising:

a stabilizer bar for stabilizing said contact carrier in said housing and a connecting means for electrically connecting said bus bar to said trace and for holding said stabilizer bar in place in said housing.

2. A switch as in claim 1 wherein said lever means further comprises plunger means for causing one of said first or second contact means to engage or disengage said bus bar or trace respectively.

3. A multi-circuit electrical switch comprising:

a housing having at least one substantially flat side and an open end opposite said flat side;

first terminal means mounted on the inner surface of said flat side;

means for closing said open end of said housing and having second terminal means thereon; and a contact carrier slidably located between said flat side and means for closing, said contact carrier comprising:

first contact means mounted on a first side of said contact carrier for contacting said first terminal means;

second contact means mounted on a second side of said contact carrier opposite said first side for contacting said second terminal means;

lever means for manually sliding said carrier to cause said first and second contacts to contact their respective terminal means; and stabilizing means for stabilizing said contact carrier in said housing, said stabilizing means including a highly finished surface.

4. A switch as in claim 3 wherein said lever means further comprises plunger means for causing one of said first or second contact means to engage or disengage said bus bar or trace respectively.

5. A switch as in claim 3 wherein said contact carrier has an opening therein and said stabilizing means includes a stabilizing bar passing through said opening in said contact carrier and having said highly finished surface.

* * * * *